US008033892B2

(12) United States Patent
Stubenfoll

(10) Patent No.: US 8,033,892 B2
(45) Date of Patent: Oct. 11, 2011

(54) TOY SYSTEMS WITH SEPARATE ACCESSORY PIECES ENGAGEABLE BY PART OF A PLAYTHING

(75) Inventor: Leonard J. Stubenfoll, Orland Park, IL (US)

(73) Assignee: Fertig Stubeufoll Design Group L.L.C., Oak Brook, IL (US)

( * ) Notice: Subject to any disclaimer, the term of this patent is extended or adjusted under 35 U.S.C. 154(b) by 769 days.

(21) Appl. No.: 12/006,177

(22) Filed: Dec. 31, 2007

(65) Prior Publication Data

US 2009/0170401 A1 Jul. 2, 2009

(51) Int. Cl.
*A63H 33/00* (2006.01)
*A63H 3/16* (2006.01)

(52) U.S. Cl. ..... 446/486; 446/97

(58) Field of Classification Search ..... 446/69, 446/72, 77, 97–101, 268, 486
See application file for complete search history.

(56) References Cited

U.S. PATENT DOCUMENTS

| | | | | | |
|---|---|---|---|---|---|
| 821,468 | A | | 5/1906 | Dashiell | |
| 949,544 | A | | 2/1910 | Muehlstein | |
| 2,623,329 | A | * | 12/1952 | Di Leva | 446/320 |
| 2,767,516 | A | * | 10/1956 | Del Mas | 446/320 |
| 2,955,382 | A | * | 10/1960 | Boles | 446/227 |
| 3,464,590 | A | * | 9/1969 | Giannettino | 221/297 |
| 3,526,991 | A | | 9/1970 | Goldfarb et al. | |
| 3,581,434 | A | * | 6/1971 | Fels | 446/309 |
| 4,356,659 | A | * | 11/1982 | Clarke | 446/97 |
| 4,720,283 | A | * | 1/1988 | Williams et al. | 446/69 |
| 5,755,632 | A | * | 5/1998 | Eddy | 473/460 |
| 6,155,904 | A | * | 12/2000 | Spector | 446/320 |
| 6,648,721 | B2 | * | 11/2003 | Rehkemper et al. | 446/390 |
| 6,790,117 | B2 | * | 9/2004 | Ruiz Gonzalez | 446/92 |
| D508,966 | S | | 8/2005 | Zehrung | |
| 7,140,945 | B2 | | 11/2006 | Dinhofer | |
| 2007/0187891 | A1 | * | 8/2007 | Hoeting | 273/236 |

* cited by examiner

*Primary Examiner* — Gene Kim
*Assistant Examiner* — Alyssa Hylinski
(74) *Attorney, Agent, or Firm* — John S. Pacocha

(57) ABSTRACT

A toy system with a body part insertable into an opening substantially defined by a separate band, retains the band to accessorize playthings by pushing them into a separate piece bearing accessories on the outer surface. Retention is by frictional or magnetic engagement. For frictional engagement, resilient material is used. A separation in the band allows it to spread apart; a coupling may limit the extent of separation. Geometric shapes of the part and opening may be substantially the same or different, as long as there are at least two points of contact for frictional engagement. A second part fits into the opening without engaging the piece and telescopes against a spring into the part engaging the piece. Removal is facilitated by a component that receives the second part, but not the part engaging the piece. Chamfers on the part inserted into the opening and/or on the opening facilitate insertion.

17 Claims, 7 Drawing Sheets

190
192
194
196
200
202
204
206
208

TOY SYSTEMS WITH SEPARATE ACCESSORY PIECES ENGAGEABLE BY PART OF A PLAYTHING

BACKGROUND OF THE INVENTION

1. Field of the Invention

This invention relates generally to toys, particularly toys which a child may manipulate to change the appearance of the toy.

2. Background Art

Children have long played with toys such as dolls and action figures which the children manipulate to change the toys' appearance. At times the manipulation required to accessorize prior art toys is often more involved than some children, particularly younger children enjoy performing. In addition, there have been toys which are pushed or pulled on, either manually or with a spring bias, to effect a change in the toy.

Zehrung Design Pat. D 508,966 issued Aug. 30, 2005 discloses a Pop-Up Pull Toy having a generally cylindrical upper part that fits into a generally cylindrical lower part without any apparent, or suggested, engagement between the sides of the upper and lower parts, or with any other piece. As disclosed, the extension of the upper part out of the lower part, and the retraction of the upper part into the lower part appears to be solely controlled by pushing and pulling on the sinusoidal rod projecting out of the bottom of the lower part, while the lower part is grasped or otherwise restrained. While there may be operating friction between the rod and the bottom of the lower part, there is no apparent, or suggested, engagement between the sides of the upper and lower parts, or with any other piece.

Dashiell U.S. Pat. No. 821,468 issued May 22, 1906 discloses a "jack-in-the-box" type toy having a spring biased figure portion that compresses inside of a hollow cylindrical casing. Rod ends engage slots inside the casing to retain the figure portion inside the casing. When the figure portion is projected from the casing by the spring, a fan carried by the figure is automatically opened.

Muehistein U.S. Pat. No. 949,544 issued Feb. 15, 1910 discloses another "jack-in-the-box" type toy with a flag carrying arctic explorer. A spring is kept compressed in a box by a number of links that pivot with respect to each other, and include a hook at one end that is latched to a staple on the outside of the box.

Goldfarb et al. U.S. Pat. No. 3,526,991 issued Sep. 8, 1970 discloses a pop-up toy which includes a spring on a lower base, and an upper portion that fits over the base. Carried under the upper portion is a suction cup, which also fits over the spring and the base. When the upper portion is pressed down against the spring bias, the suction cup sticks to a flat surface, and temporarily keeps the upper portion from being popped back up by the compressed spring.

Dinhofer U.S. Pat. No. 7,140,945 issued Nov. 28, 2006 discloses a pop-up toy in which a spring is attached to a top and a base, with extending arms just below the top to the spring. The base is weighted to keep it from bouncing away from the surface it is standing on when the spring is released.

There remains a need, however, for toy systems that provide a unique way to accessorize playthings by pushing the plaything into a separate piece with "clothing" or accessories painted, sculpted, or otherwise put on the outer surface of the piece.

SUMMARY OF THE INVENTION

The present invention is concerned with providing toy systems having a body including at least a first part with at least one end, a piece separate from the body, the separate piece substantially defining an opening, the at least one end of the part being insertable into the opening, and the part engaging the separate piece to retain the separate piece on the body.

The part may frictionally engage the separate piece to retain the separate piece, in which case the separate piece is made of a resilient material, and is either a complete band substantially defining the opening or has a separation forming an incomplete band substantially defining the opening. A coupling, such as a hinge, clip, or tabs, may be provided between the opposed ends of the band substantially defining the opening. The geometric shapes of the part and the opening may be substantially the same or may be different, such as a polygon and a circle, as long as there are at least two, preferably three, points of contact for engagement. As an alternative to frictional engagement, the part may magnetically engage the separate piece to retain the separate piece.

The first part may be provided with an interior space, and the system may include a second part that is at least partially in the interior space, with a spring biasing the part and the second part away from each other, the second part not at least partially in the interior space is insertable into the opening substantially defined by the separate piece without engaging the separate piece, and the first part is telescopically moveable against the spring biasing into engagement with the opening substantially defined by the separate piece and retaining the separate piece when the spring biasing moves the first part away from the second part.

The toy system may also include a component with an open top that receives the second part not at least partially in the interior space, the component having an outer configuration over which the opening substantially defined by the separate piece fits without engagement of the component and the separate piece, and the open top of the component engaging the at least one end of the part being insertable into the opening when the first part is moved telescopically over the second part against the spring biasing.

The at least one end of the part insertable into the opening substantially defined by the separate piece may be chamfered to facilitate insertion of the at least one end of the part into the opening substantially defined by the separate piece. Alternatively, or in addition, the opening substantially defined by the separate piece may be chamfered to facilitate insertion of the at least one end of the part into the opening substantially defined by the separate piece.

BRIEF DESCRIPTION OF THE DRAWINGS

For a better understanding of the present invention, reference may be had to the accompanying drawings in which.

DETAILED DESCRIPTION

Figure 1:
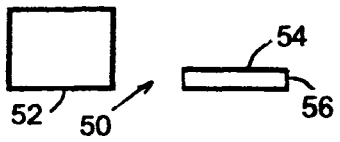
FIG. 1 is a schematic front elevation view of components of an embodiment of the present invention.
Figure 3:
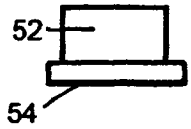
FIG. 3 is a schematic front elevation view of the components of the embodiment shown in FIG. 1 put together.
Figure 4:
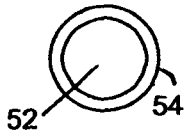
FIG. 4 is a schematic top plan view of the components of the embodiment shown in FIG. 1 put together.
Figure 6:
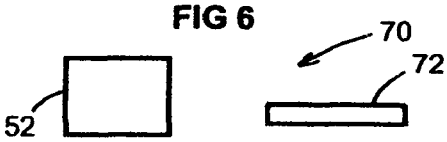
FIG. 6 is a schematic front elevation view of components of another embodiment of the present invention.

Referring now to the drawings, in which like elements are identified by like reference numerals, there is schematically shown in FIGS. 1-4 a toy system 50 comprising the most basic embodiment of the present invention. More particularly, toy system 50 includes a body component 52 and a separate piece providing an accessory component 54. Body 52 as illustrated in FIGS. 1-4 is of a generally cylindrical shape and has a predetermined outer dimension or diameter, as for example 1.500 inches; it may be made of a material that is somewhat rigid, such as polystyrene (PS), acrylonitrile butadiene styrene (ABS), or polycarbonate (PC). Accessory 54, is a band generally in the shape of a ring having an outer surface 56 and defining an opening 58 having an initial, pre-selected, inner diameter, as for example 1.450 inches, that is slightly less than, the predetermined outer diameter of body 52. The accessory is made of a flexible, elastic material, such as a partially reticulated polyether type polyurethane foam, so that opening 58 will sufficiently expand upon insertion of body 52 and then contract to be retained about body 52 as is illustrated in FIGS. 3 and 4.

Figure 5:
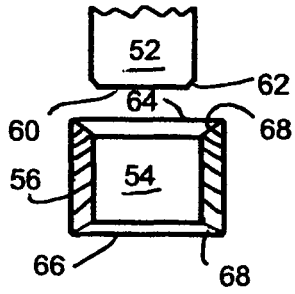
FIG. 5 is an enlarged, fragmentary view, partially in section taken generally vertically through the center of one of the components of the embodiment shown in FIG. 1.
Figure 2:
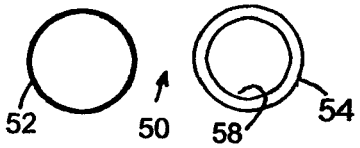
FIG. 2 is a schematic top plan view of the components of the embodiment shown in FIG. 1.

To facilitate insertion of body 52 into accessory 54, the free, lower as illustrated in FIGS. 1-5, end 60 of body 52 is provided with a slight taper or chamfer 62 as is shown in FIG. 5. In addition, or as an alternative to chamfer 62 on end 60 of the body, one end 64 of accessory 54, or both ends 64 and 66 as illustrated in FIG. 5, may be provided with a slight taper or chamfer 68 to facilitate insertion of body 52.

As illustrated in FIGS. 3 and 4, toy system 50 is put together by a child placing body 52 atop accessory 54 and then pushing down as illustrated by the arrow in FIG. 3 to attach accessory 54 to body 52. Although only schematically shown in FIGS. 1-5, it will be apparent to those skilled in the art, and particularly from variations of the present invention shown in FIGS. 25-26 and 27-34 that both the designs of the body component and one or more of the accessory component, particularly the outer surface, may be molded, sculpted or otherwise embellished to provide various characters or other playthings which are thematically related and which attachment and removal of the one or more accessory components enhance and provide play.

FIGS. 6-9 illustrate another toy system 70 of the present invention in which body component 52 is the same as that previously shown and described with respect to toy system 50. However, in toy system 70, accessory component 72, is a band or ring with a slit, separation, or break 74. Accessory component 72 also provides an outer surface 76, and still substantially defines an opening 78. Before accessory 72 is put on a body, substantially defined opening 78 has an initial, pre-selected inner diameter, for example 1.440 inches in the case of a band with a 0.125 inch wall thickness, that is slightly less than the predetermined 1.500 inch outer diameter of body 52. As the wall thickness of the accessory band or ring of the same material increases, the difference between the outer diameter of the body and the inner diameter of the opening may decrease because of the greater compression strength of the thicker band. Chamfers such as 62 and/or 68 may again be provided to facilitate insertion of body 52 into accessory 72.

Figure 8:
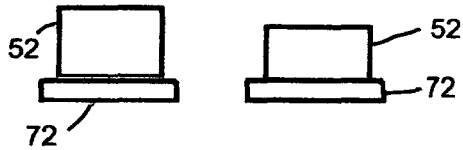
FIG. 8 is a schematic front elevation view of the components of the embodiment shown in FIG. 6 put together in a sequence of two steps.
Figure 7:
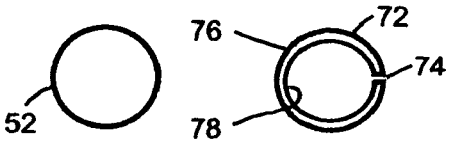
FIG. 7 is a schematic top plan view of the components of the embodiment shown in FIG. 6.
Figure 9:
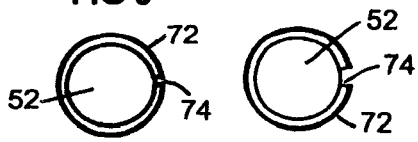
FIG. 9 is a schematic top plan view of the components of the embodiment shown in FIG. 6 put together in the same sequence of two steps as in FIG. 8.
Figure 11:
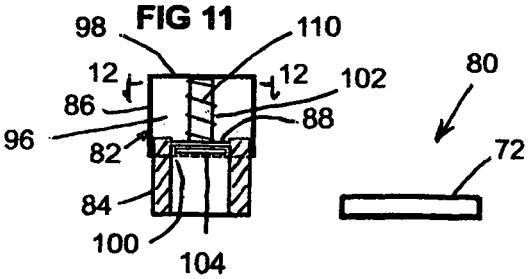
FIG. 11 is a schematic sectional view of one of the components taken generally along line 11-11 of FIG. 10 and a schematic front elevation view of the other component of the embodiment shown in FIG. 10.
Figure 10:
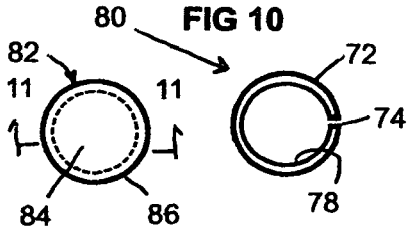
FIG. 10 is a schematic top plan view of components of yet another embodiment of the present invention.
Figure 12:
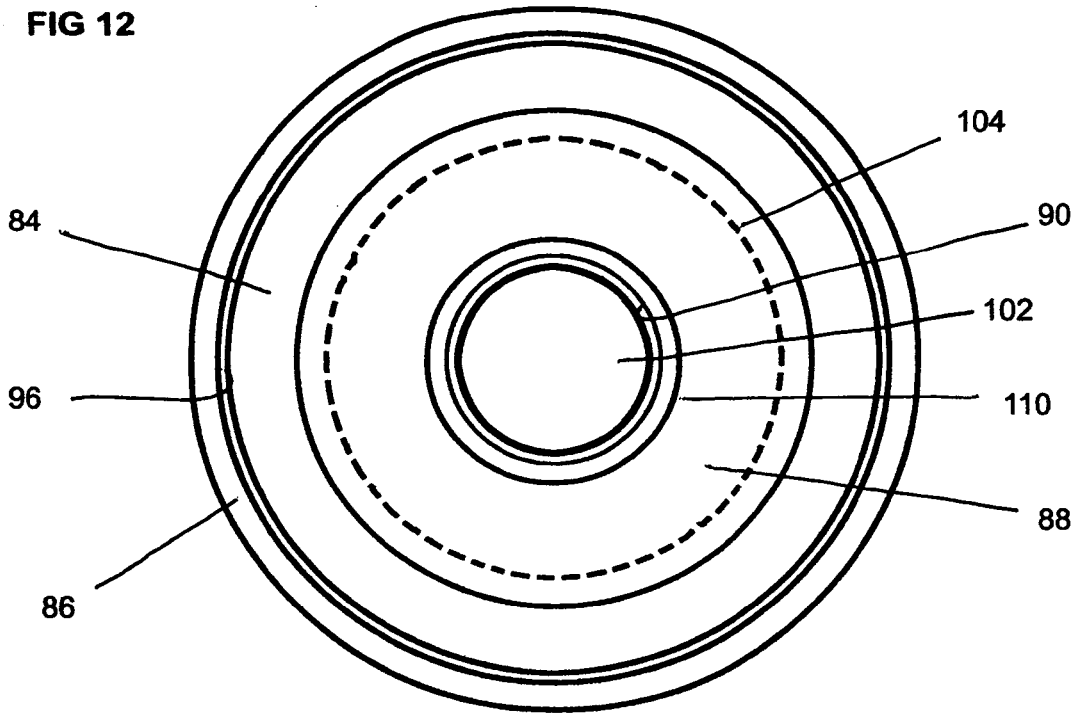
FIG. 12 is an enlarged sectional view of one of the components taken generally along line 12-12 of FIG. 11.

Toy system 70 is put together by a child placing body 52 atop accessory 72 and then pushing down as illustrated by the arrow in FIG. 8 to attach accessory 72 to body 52. Opening 78 will effectively expand upon insertion of body 52, at least in part by spreading apart band 72, more particularly separation 74, as illustrated in FIGS. 8 and 9, and then contract to be retained about body 52. While it is still desirable to make accessory 72 out of a flexible, elastic material system 70 does not rely on the resiliency of the material itself to the extent that system 50 does, and hence there may be a larger number of acceptable materials, such as acrylonitrile butadiene styrene (ABS), vinyl, or nylon.

Toy system 80, which is illustrated in FIGS. 10-13, has the same accessory component 72 as toy system 70. However, body 82 comprises a lower part 84 and an upper part 86, which are telescopically related to each other. Lower part 84 is of a generally tubular shape that is circular in cross-section. There is an upper inner shoulder 88 that has a generally central aperture 90. Lower part 84 has an outer dimension or diameter, as for example 1.250 inches, that is significantly less than opening 78 of accessory 72 such that lower part 84 easily slips in and out of opening 78 of accessory 72 without any retention or attachment of accessory 72 by lower part 84.

Upper part 86 is also of a generally tubular shape that is circular in cross-section with an interior space 96, a closed top 98, and an open bottom 100. Depending from closed top 98 is a post 102 with an enlarged bottom cap or head 104. Post 102 is generally cylindrical and, except for cap 104, has an outer diameter that readily fits in aperture 90 and allows for reciprocal movement of post 102 with aperture 90. Cap 104 is sufficiently larger than aperture 90 so as not to be able to pass through aperture 90. Part 86 has an inner diameter sufficiently large to permit telescopic movement of lower part 84 into and out of upper part 86. Around post 102, between the underside of closed top 98 and the upper side of shoulder 88, is a coil spring 110 to bias parts 84 and 86 apart. As is perhaps best shown in FIG. 11, cap 104 is on the underside of shoulder 88 to keep assembled parts 84 and 86 from coming apart. Again, tapers or chamfers such as 62 and/or 68 may again be provided to facilitate insertion of upper part of body 82 into accessory 72.

Figure 13:
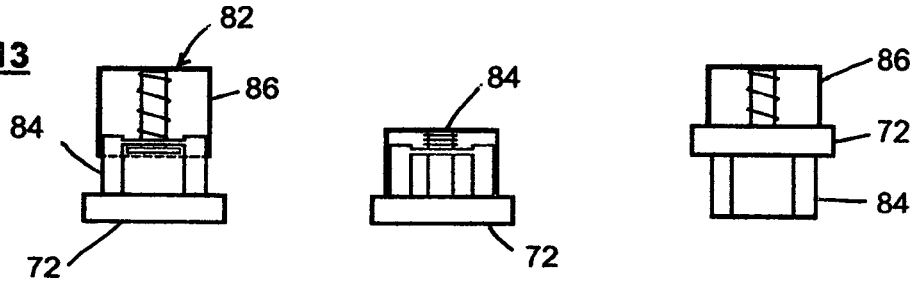
FIG. 13 is a schematic front elevation view of the components of the embodiment shown in FIGS. 10 and 11 put together in a sequence of three steps.
Figure 14:
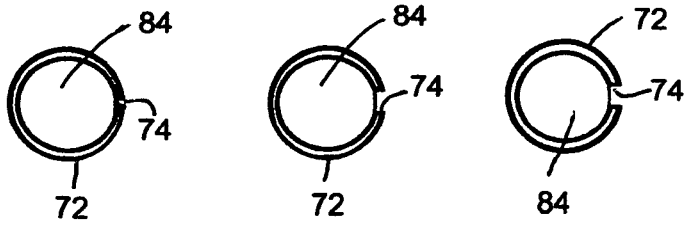
FIG. 14 is a schematic top plan view of the components of the same three step sequence as in FIG. 13.

The outer dimension or diameter of upper part 86 is slightly larger than opening 78 of accessory 72. As illustrated in FIGS. 13 and 14, toy system 80 is put together by a child placing body 82 with lower part 84 atop accessory 72 and then pushing down as illustrated by the arrow in the middle sequence step of FIG. 13 to attach accessory 72 to body 82, or more particularly to upper part 86. When body 82 is released by the child, the bias of spring 110 will return upper part 86, with accessory 72 attached, upwardly as illustrated by the arrow in the leftmost sequence step of FIG. 13.

Figure 15:
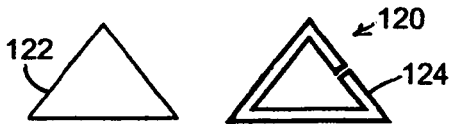
FIG. 15 is a schematic top plan view of components of still another embodiment of the present invention.
Figure 16:
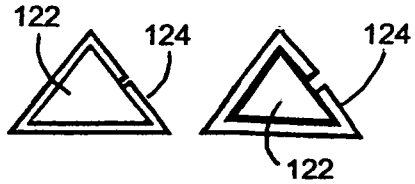
FIG. 16 is a schematic top plan view of the components of the embodiment shown in FIG. 15 put together in a sequence of two steps.
Figure 17:
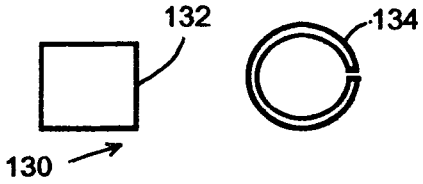
FIG. 17 is a schematic top plan view of components of a further embodiment of the present invention.
Figure 18:
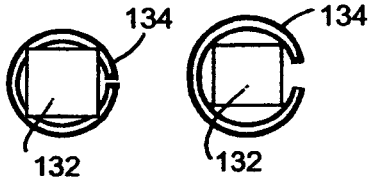
FIG. 18 is a schematic top plan view of the components of the embodiment shown in FIG. 17 put together in a sequence of two steps.
Figure 19:
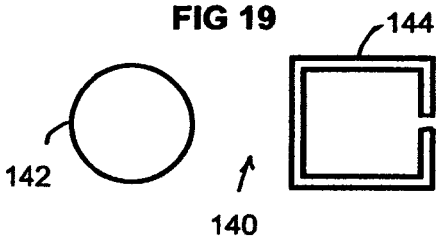
FIG. 19 is a schematic top plan view of components of another further embodiment of the present invention.
Figure 20:
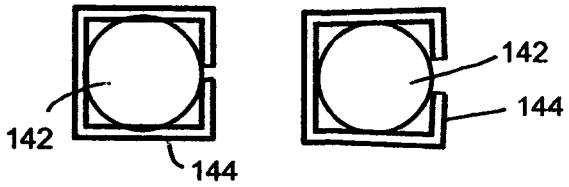
FIG. 20 is a schematic top plan view of the components of the embodiment shown in FIG. 19 put together in a sequence of two steps.

Embodiments of the present invention have so far been shown and described in terms of round geometric shapes with cylindrical bodies and circular or ring bands, all with circular cross-sections. However as indicated by toy system 120, body 122 and accessory 124 may be polygons in cross-section, such as the triangles illustrated in FIGS. 15 and 16, or any other numbers of sides. Indeed, the body and the accessory need not be of the same type of geometric shape, as long as the geometric shape of the part has at least two points that engage the geometric shape of the opening substantially defined by the separate piece, although at least three points of engagement are preferred. FIGS. 17-18 illustrate toy system 130 in which body 132 is a polygon, more particularly a square, and accessory 134 is a circular band. Toy system 140 as illustrated in FIGS. 19-20 has a cylindrical body 142 and a polygon, more particularly a square, accessory 144.

Figure 23:
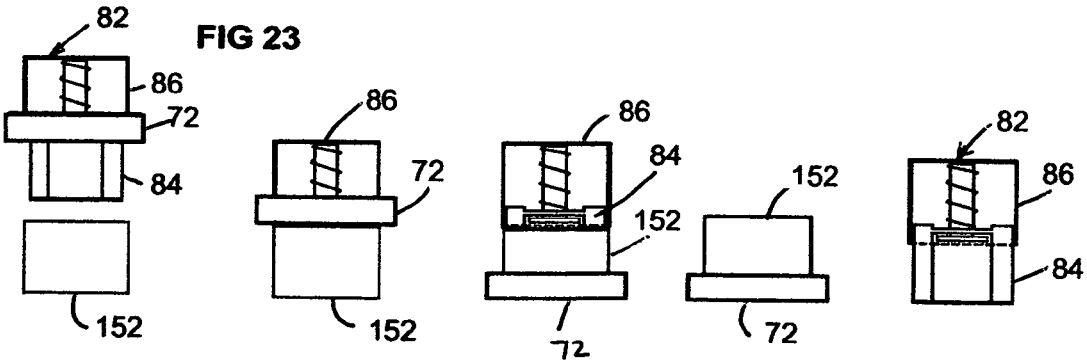
FIG. 23 is a schematic front elevation view of the put together components of the embodiment shown in FIGS. 13 and 14 taken apart in a sequence of four steps using the additional component shown in FIGS. 21 and 22.

FIGS. 21-24 illustrate toy system 80 with an additional remover component 152 that assists in the removal of accessory 72 from upper part 86 of body 82. Remover 152 is cup shaped, although it could be a sleeve with an open top and an open bottom, with an outer diameter and an opening 156 having an inner diameter. Outer diameter is significantly less than opening 78 of accessory 72; as an example, if accessory inner diameter 78 is 1.440 inches, remover outer diameter is 1.440 inches or less. Remover opening 156 has an inner diameter larger than the outside diameter of lower part 84 but smaller than the outside diameter of upper part 86; for example, if the outside diameter of lower part 84 is 1.250 inches and the outside diameter of upper part 86 is 1.500 inches, then the remover opening inner diameter is 1.300 inches. Lower part 84 loosely fits in opening 156 of remover 152, as illustrated in FIG. 23. Upper part 86 with an attached accessory 72 is pushed down atop remover 152, upper part 86 is stopped by remover 152 and the accessory is pushed off of body 82 and is then easily lifted off of remover 152, or remover 152 is picked up leaving accessory 72.

Figure 21:
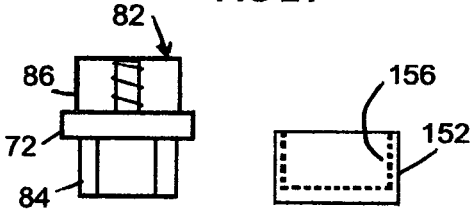
FIG. 21 is a schematic front elevation view of the components of the embodiment of the present invention shown in FIGS. 10-14 plus an additional component.
Figure 22:
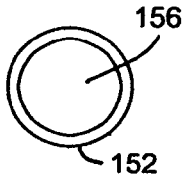
FIG. 22 is a schematic top plan view of one of the components of the embodiment shown in FIG. 21.
Figure 24:
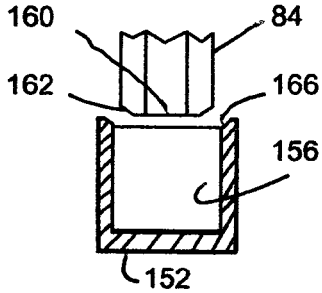
FIG. 24 is an enlarged, fragmentary view, partially in section taken generally vertically through the center of one of the components of the embodiment shown in FIG. 21.

To further facilitate insertion of lower part 84 of body 82 into opening 156 of remover 152, the free, lower as illustrated in FIGS. 21, 23 and 24, end 160 of lower part 84 is provided with a slight taper or chamfer 162 as is shown in FIG. 24. In addition, or as an alternative to chamfer 162 on end 160 of the body lower part, opening 156 of remover 152 may be provided with a slight taper or chamfer 166.

Figure 25:
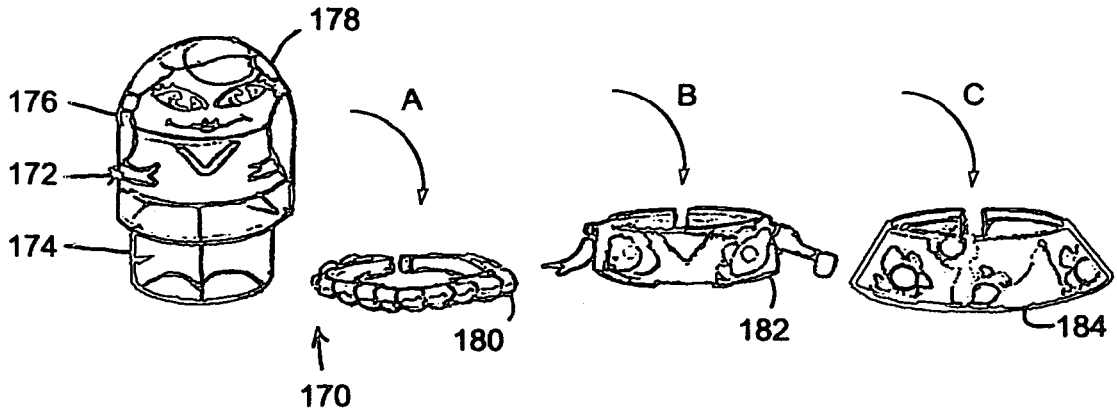
FIG. 25 is a perspective view of components of a variation of the embodiment of the present invention schematically shown in FIGS. 10-14 with additional accessory components.
Figure 26:
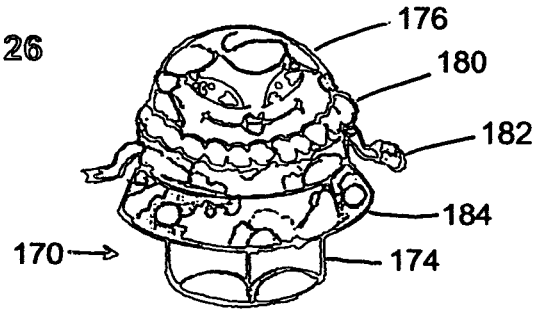
FIG. 26 is a front elevation view of the components of the variation of the embodiment shown in FIG. 25 put together.

A variation of the embodiment of the present invention schematically shown in FIGS. 10-14, with additional accessory components, is illustrated in FIGS. 25 and 26 as a doll or figure toy system 170. Body 172, which is structurally and functionally the same as body 82, is designed such that lower part 174 appears as the legs and feet, or lower torso, of a doll or figure. Upper part 176, which is conveniently provided with a rounded dome top 178, is designed as the upper torso and head. Rather than just a single accessory component 72, toy system 170 has a series of three thematically designed accessory components 180, 182, and 184, each of which is structurally and functionally the same as accessory component 72. Each of accessory components 180, 182, and 184 is attached to body 172, preferably in the left to right, A, B, C, order as indicated by the arrows in FIG. 26. A completed, dressed doll or figure results, as illustrated in FIG. 26.

As will be apparent to those skilled in the art, the design of the body and accessory components may be of any design, such as a military figure, and is not limited to any particular design shown and described. In another variation, a number of accessory components may be designed for a particular body so that the accessory components may be attached by the child in more than just one order to result in different appearing completed figures. In a series of related toy systems, accessory components may be interchangeably used with different body components.

Figures 27, 28, 29, 30, 31, 32, 33:
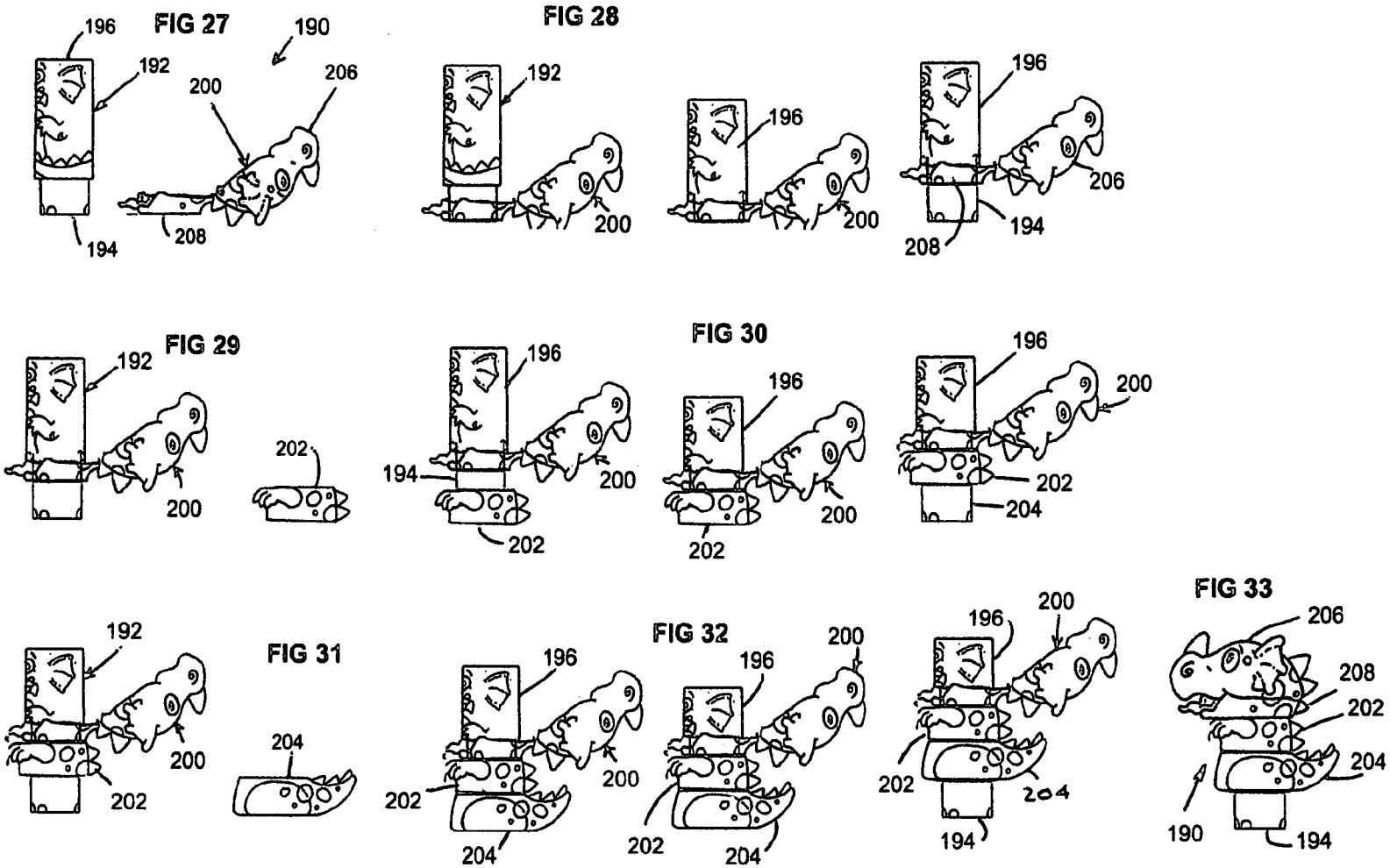
FIG. 27 is a front elevation view of components of another variation of components of the embodiment of the present invention schematically shown in FIGS. 10-14.
FIG. 28 is a front elevation view of the components of the variation shown in FIG. 27 put together in a sequence of three steps.
FIG. 29 is a front elevation view of the components of the variation shown in FIG. 27 plus an additional component.
FIG. 30 is a front elevation view of the components of the variation shown in FIG. 29 put together in a sequence of three steps.
FIG. 31 is a front elevation view of the components of the variation shown in FIG. 29 plus an another additional component.
FIG. 32 is a front elevation view of the components of the variation shown in FIG. 31 put together in a sequence of three steps.
FIG. 33 is a front elevation view of the components of the variation of the embodiment put together as shown in FIG. 32.

Another variation of the embodiment of the present invention schematically shown in FIGS. 10-14, with additional accessory components, is illustrated in FIGS. 27-34 as a dragon figure toy system 190. Body component 192, with lower part 194 and upper part 196, is structurally and functionally the same as body 82. Each of accessory components, namely, head 200, arms 202, and tail 204, is structurally and functionally the same as accessory component 72. Head component 200 is further embellished with an upper head portion 206 which is pivotally attached to lower head portion 208. The accessory components may be serially attached, in the manner previously described with respect to the embodiment of FIGS. 10-14, as illustrated in FIGS. 28, 30, and 32 to complete the dragon toy system 190 shown in FIG. 33.

Figure 34:
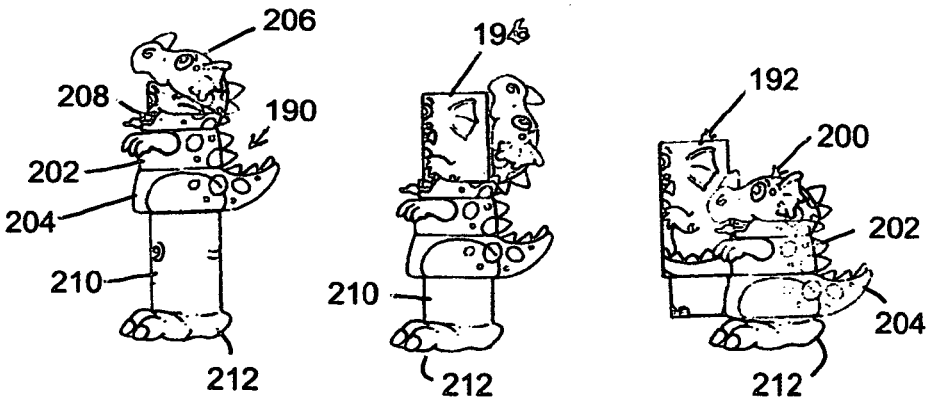
FIG. 34 is a front elevation view of the put together components shown in FIG. 33 taken apart in a sequence of three steps using yet another component.

To both facilitate removal and provide additional play, toy system 190 is provided with a remover component 210, which is thematically related as a dragon foot 212, as illustrated in FIG. 34. Remover component 210 is structurally and functionally the same as remover component 152, with the exception of lower foot portion 212 that prevents the accessory components from coming off the bottom of the remover component. As illustrated by the sequence of steps in FIG. 34, the completed dragon figure is placed upon remover 210 and pushed down by the child in the direction of the arrow shown in the middle step of FIG. 34. All of dragon accessory components 200, 202, and 204 may then be pushed down onto remover 210. The accessory components may then be easily taken off of the top of remover 210, or left on as illustrated in the last, leftmost step of FIG. 34.

Figure 35:
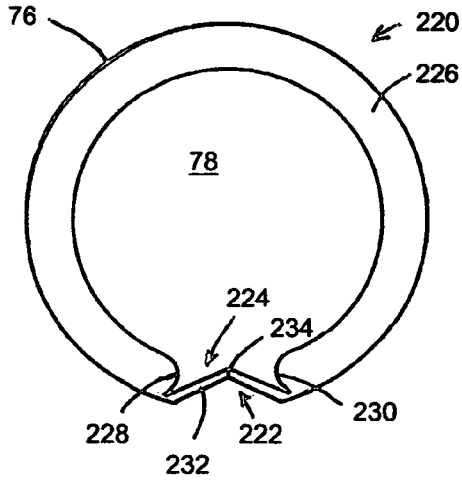
FIG. 35 is a schematic top plan view of a modification of the accessory component of the embodiments shown in FIGS. 2-34.

Modifications of the accessory component of the embodiments shown in FIGS. 2-34 are illustrated in FIGS. 35-38. In all of these modifications, the accessory band still has a separation or break, an outer surface 76, and still substantially defines an opening 78. However, while the separation in these modifications still permits circumferential expansion, and contraction, of opening 78 they are designed to limit the extent of separation. The modification illustrated in FIG. 35 has a band 220 including an integrally formed coupling hinge 222 bridging separation 224. Band 220 is generally of a predetermined wall thickness 226 and has a pair of spaced apart opposed ends 228 and 230. Hinge 222 is of a thinner wall thickness 232 and pivots at its center 234, as well as at opposed ends 228 and 230. As illustrated in FIG. 35, opening 78 of band 220 may expand from what is shown in FIG. 35 until hinge 222 moving in the direction of the arrow is substantially aligned with the outer circumference of band 220.

Figure 36:
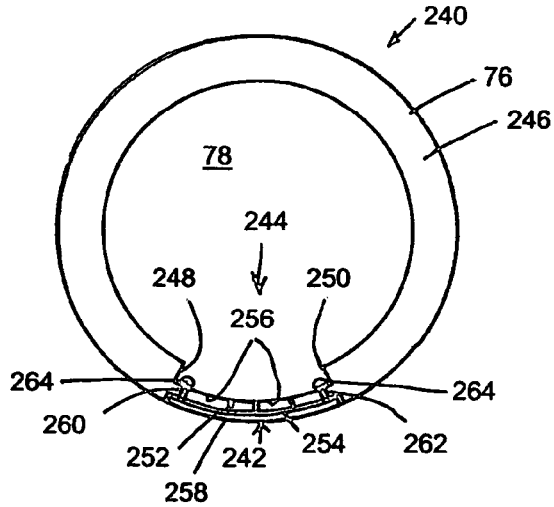
FIG. 36 is a schematic top plan view of another modification of the accessory component of the embodiments shown in FIGS. 2-34.

FIG. 36 illustrates another modification in which accessory component 240 has a locking attachment coupling 242 that bridges separation 244. Band 240 is generally of a predetermined wall thickness 246 and has a pair of spaced apart opposed ends 248 and 250. Tabs 252 and 254 extend, respectively, from ends 248 and 250. Each tab has an elongated slot 256. A clip 258 has a pair of spaced apart, generally transversely projecting pins 260 and 262, each of which has an enlarged free end 264. The diameter of each pin, except for enlarged end head 264, fits easily for sliding movement in one of slots 256. Enlarged end heads 264 may be forced through the slots to capture clip 258 while permitting tabs 252 and 254 to slide in the slots, and their respective ends 248 and 250 to expand circumferentially until pins 260 and 262 abut the ends of slots 256 in tabs 252 and 254.

Figure 37:
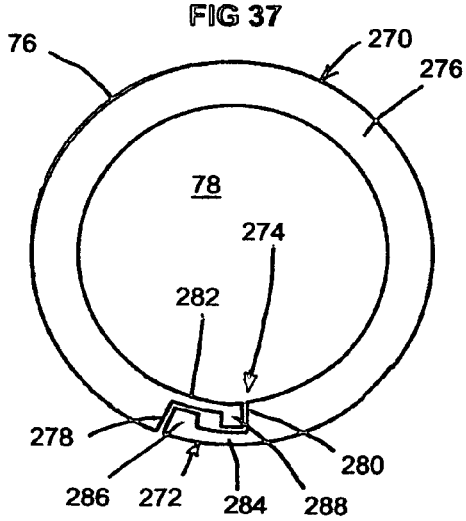
FIG. 37 is a schematic top plan view of yet another modification of the accessory component of the embodiments shown in FIGS. 2-34.
Figure 38:
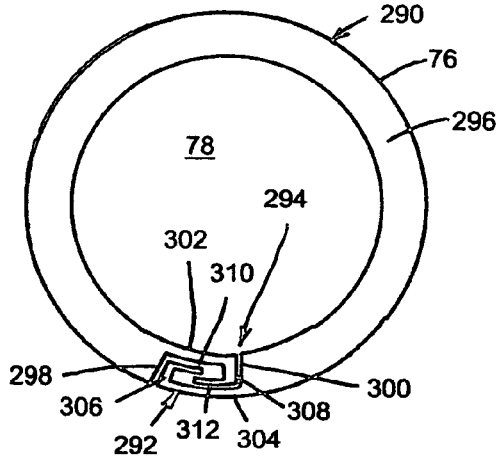
FIG. 38 is a schematic top plan view of still another modification of the accessory component of the embodiments shown in FIGS. 2-34.
Figure 39:
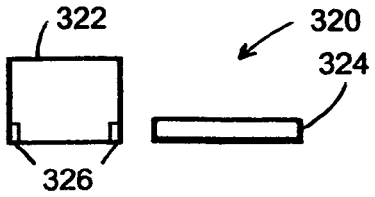
FIG. 39 is a schematic front elevation view of components of a yet another further embodiment of the present invention.
Figure 40:
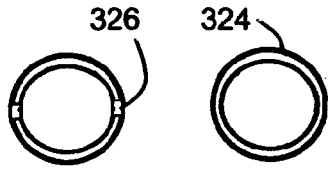
FIG. 40 is a schematic bottom plan view of the components of the embodiment shown in FIG. 39.
Figure 41:
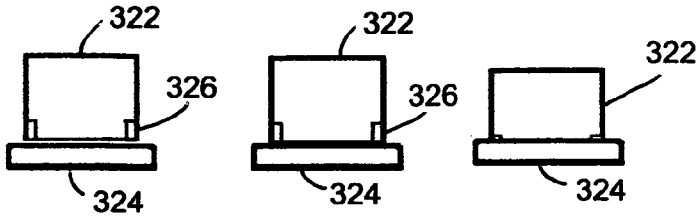
FIG. 41 is a schematic front elevation view of the components of the embodiment shown in FIG. 39 put together in a sequence of three steps.
Figure 42:
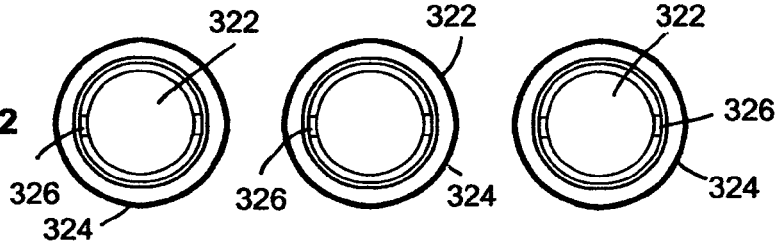
FIG. 42 is a schematic bottom plan view of the components of the embodiment shown in FIG. 39 put together in the same three step sequence as in FIG. 41.
Figure 44:
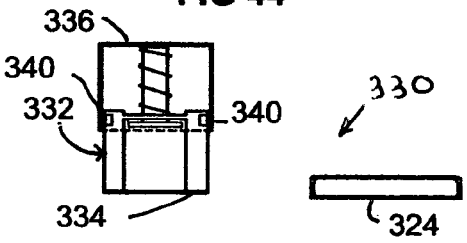
FIG. 44 is a schematic front elevation view of the components of the embodiment shown in FIG. 43.
Figure 43:
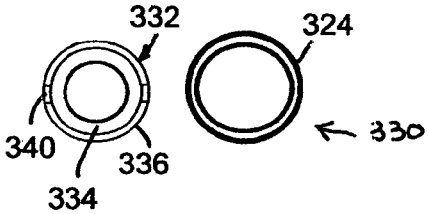
FIG. 43 is a schematic bottom plan view of components of still another further embodiment of the present invention.

The modifications of the accessory component illustrated in FIGS. 37 and 38 have integrally formed latches for limiting the circumferential expansion of the separation of the band and enlarging of opening 78. Band 270 has a latch coupling 272 that limits the spreading of separation 274. Most of band 270 is generally of a predetermined wall thickness 276 extending between a pair of spaced apart opposed ends 278 and 280. A pair of tabs 282 and 284 extend toward each other from ends 278 and 280, respectively. Each tab has an inwardly directed projection 286, 288 adjacent its end. As will be appreciated from the illustration in FIG. 37, separation 274 and opening 78 may be enlarged circumferentially until projections 286 and 288 abut.

In the modification illustrated in FIG. 38 the integrally formed latch also limits spreading of the separation generally transverse to the circumference. Accessory band 290 has a latch coupling 292 that limits the spreading of separation 294 both circumferentially and generally diametrically. Band 290 is generally of a predetermined wall thickness 296 extending between a pair of spaced apart opposed ends 298 and 300. Tabs 302 and 304 extend toward each other from ends 298 and 300, respectively. Adjacent the extended end of each tab is a generally transverse, inwardly directed projection 306, 308. Each inwardly directed projection 306, 308 then has a generally transverse, backwardly directed protrusion 310, 312 adjacent the end of the respective projection. Separation 294 and opening 78 may be enlarged circumferentially until projections 306 and 308 abut, and spreading of separation 294 generally transverse to the circumference is limited by protrusions 310 and 312 abutting or engaging.

FIGS. 39-46 illustrate embodiments of the present invention in which the engagement between the body component and accessory component is magnetic, rather than frictional as in the embodiments illustrated in FIGS. 1-14. Schematically shown in FIGS. 39-42 is a toy system 320 that includes a body component 322 and an accessory component 324. Body 322 as illustrated in FIGS. 35-38 is generally cylindrical and has a predetermined outer dimension or diameter, as for example 1.500 inches. One or more magnets, conveniently shown as a pair of diametrically spaced apart magnets 326 adjacent the bottom of body 322, are included as part of body 322. Accessory 324, is a band generally in the shape of a ring with an opening 328 having an initial, pre-assembled, inner diameter, as for example 1.550 inches, that is slightly more than the predetermined outer diameter of body 322, so that body 322 readily fits into the opening of accessory 324. The accessory is made of a ferrous or other magnetic material, or at least has a magnetic outer coating or skin, so that when a child places body 322 atop accessory 324, and pushed down in the direction of the arrow shown in the middle step of FIG. 41, accessory 324 is magnetically retained on body 322 as is illustrated by the sequence of steps in FIGS. 41 and 42. Slight tapers or chamfers, similar to chamfers 62 and 68 shown and described above with respect to the embodiment of FIGS. 1-5, may be provided to facilitate insertion of body 322 into accessory 324.

Another magnetic attachment toy system 330 is illustrated in FIGS. 43-46 in which body component 332 has a lower part 334 and an upper part 336 that are structurally and dimensionally similar to lower part 84 and upper part 86 of body 82, and functionally related to each other in the same way as lower part 84 and upper part 86 of body 82. More particularly, shoulder 88 and aperture 90 of lower part 334 are the same as those of lower part 84, and closed top 98, open bottom 100, post 102 and cap 104 of upper part 336 are the same as those of upper part 86. Spring 110 is carried by post 102 and biases lower part 334 and upper part 236 apart the same as parts 84 and 86. However, one or more magnets, conveniently shown as a pair of diametrically spaced apart magnets 340 adjacent the bottom of lower part 334.

Accessory component 324, in toy system 330, is the same as in toy system 320. Lower part 334 has an outer dimension, as for example 1.300 inches, that allows it to easily slip in and out of opening 328 of accessory 324 without and retention or attachment of accessory 324 by lower part 334. The lower or bottom end of upper part 334 also fits into opening 328 of accessory 324.

Figure 45:
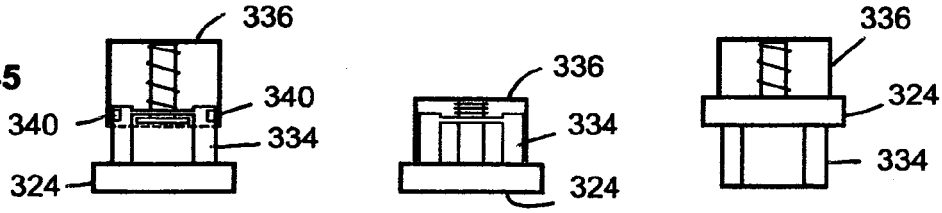
FIG. 45 is a schematic front elevation view of the components of the embodiment shown in FIG. 43 put together in a sequence of three steps.
Figure 46:
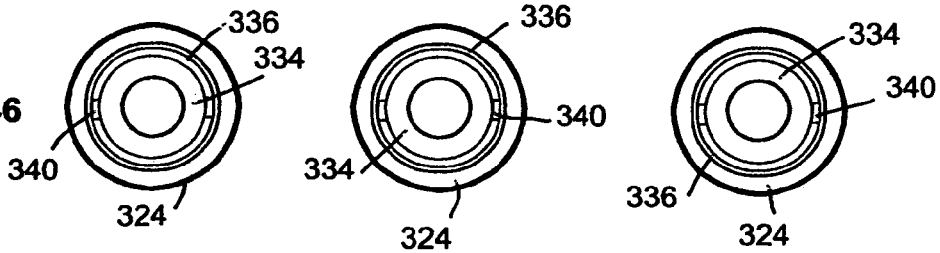
FIG. 46 is a schematic bottom plan view of the components of the embodiment shown in FIG. 43 put together in the same three step sequence as in FIG. 45.

As illustrated in FIGS. 45 and 46, toy system 330 is put together by a child placing body 332 with lower part 334 atop accessory 324 and then pushing down as illustrated by the arrow in the middle sequence step of FIG. 45 to magnetically attach accessory 324 to body 332, or more particularly to upper part 336. When body 332 is released by the child, the bias of spring 110 will return upper part 336, with accessory 324 attached, upwardly as illustrated by the arrow in the leftmost sequence step of FIG. 45.

The embodiments of FIGS. 39-46 have been shown and described in terms of round geometric shapes with cylindrical bodies and circular or ring bands, but may be polygons or combinations of polygon and round shapes as was previously shown and described with respect to the embodiments of FIGS. 1-14. Also, although only schematically shown in FIGS. 39-46, it will be apparent to those skilled in the art, and particularly from variations of the present invention shown in FIGS. 25, 26 and 27-34 that both the designs of the body component and one or more of the accessory component may be embellished to provide various characters or other playthings which are thematically related and which attachment and removal of the one or more accessory components enhance and provide play.

While particular embodiments of the invention have been shown and described with some variations and alternatives, further variations and modifications will occur to those skilled in the art. It is intended in the appended claims to cover all such variations and modifications that come within the true spirit and scope of the present invention.

What is claimed as new and desired to be secured by Letters Patent is:

1. A toy system comprising:

a body including at least a first part with at least one end;

the first part has an interior space;

a second part that is at least partially in the interior space;

a spring biasing the part and the second part away from each other;

a piece separate from the body supportable on a surface;

the separate piece substantially defining a non-collapsible opening;

the second part not at least partially in the interior space being insertable into the opening substantially defined by the separate piece without engaging the separate piece;

the at least one end of the first part being insertable into the opening;

the first part engaging the separate piece to retain the separate piece on the body; and the first part being telescopically moveable over the second part, against the spring biasing, into engagement with the opening substantially defined by the separate piece to pick up and retain the separate piece when the spring biasing moves the first part away from the second part.

2. The toy system of claim 1 including:

a component with an open top that receives the second part not at least partially in the interior space;

the component having an outer configuration over which the opening substantially defined by the separate piece fits without engagement of the component and the separate piece; and the open top of the component engaging the at least one end of the part being insertable into the opening when the first part is moved telescopically over the second part against the spring biasing.

3. The toy system of claim 1 in which at least one of the at least one end of the part insertable into the opening substantially defined by the separate piece, or the opening substantially defined by the separate piece, is chamfered to facilitate insertion of the at least one end of the part into the opening substantially defined by the separate piece.

4. The toy system of claim 1 in which the first part frictionally engages the separate piece to retain the separate piece.

5. The toy system of claim 4 in which the separate piece is a complete band substantially defining the opening.

6. The toy system of claim 4 in which the separate piece has a separation forming an incomplete band substantially defining the opening.

7. The toy system of claim 6 in which the separation forming an incomplete band substantially defining the opening has a pair of spaced apart, opposed ends, and a coupling between the opposed ends.

8. The toy system of claim 7 in which the coupling between the opposed ends is a hinge.

9. The toy system of claim 7 in which the coupling between the opposed ends comprises:

a slotted tab extending from each opposed end toward the other opposed end;

a clip with a pair of spaced apart, generally transversely projecting pins; and each of the pins being captured for sliding movement in a respective one of the slots.

10. The toy system of claim 7 in which the coupling between the opposed ends comprises:

a tab extending from each opposed end toward the other opposed end; and;

an inwardly directed projection adjacent the end of each of the tabs.

11. The toy system of claim 10 in which the coupling between the opposed ends further comprises a backwardly directed protrusion adjacent the end of the projection.

12. The toy system of claim 1 in which:

the part has a geometric shape; and the opening substantially defined by the separate piece has substantially the same geometric shape as the geometric shape of the part.

13. The toy system of claim 12 in which the geometric shape of the part and the geometric shape of the opening defined by the separate piece are circular in cross-section.

14. The toy system of claim 12 in which the geometric shape of the part and the geometric shape of the opening defined by the separate piece are a polygon in cross-section.

15. The toy system of claim 1 in which:

the part has a geometric shape; and the opening substantially defined by the separate piece has a different geometric shape than the geometric shape of the part.

16. The toy system of claim 15 in which the geometric shape of the part is a polygon in cross-section and the geometric shape of the opening substantially defined by the separate piece is circular in cross-section.

17. The toy system of claim 15 in which the geometric shape of the part is circular in cross-section and the geometric shape of the opening substantially defined by the separate piece is a polygon in cross-section.

* * * * *